US007232148B2

(12) United States Patent
Gonthier

(10) Patent No.: US 7,232,148 B2
(45) Date of Patent: Jun. 19, 2007

(54) DEVICE FOR RETAINING A BOOT ON A GLIDING, ROLLING, OR WALKING BOARD ADAPTED TO A SPORTING ACTIVITY, AND THE BOOT THEREFOR

(75) Inventor: Jean-François Gonthier, Viuz la Chiesaz (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 10/963,522

(22) Filed: Oct. 14, 2004

(65) Prior Publication Data

US 2005/0046151 A1 Mar. 3, 2005

Related U.S. Application Data

(63) Continuation of application No. 09/968,949, filed on Oct. 3, 2001, now Pat. No. 6,863,285.

(30) Foreign Application Priority Data

Oct. 6, 2000 (FR) ..... 00 13032

(51) Int. Cl.
*A43B 5/04* (2006.01)

(52) U.S. Cl. ..... 280/636; 36/117.1

(58) Field of Classification Search ..... 280/14.22, 280/14.24, 11.36, 611, 619, 623, 624, 634, 280/636; 36/117.1, 133, 138, 65, 66
See application file for complete search history.

(56) References Cited

U.S. PATENT DOCUMENTS 2,819,907 A 1/1958 Thoresen ..... 280/87.042
3,191,321 A * 6/1965 Brutting ..... 36/133
3,525,165 A * 8/1970 Randall, Jr. ..... 36/133
3,650,051 A * 3/1972 Sass ..... 36/133
3,801,119 A 4/1974 Andre ..... 280/11.35 K
4,268,062 A 5/1981 Wittmann ..... 280/618
4,284,292 A 8/1981 Faulin ..... 280/618
4,542,599 A 9/1985 Annovi ..... 36/117.4
4,587,749 A * 5/1986 Berlese ..... 36/131
4,882,858 A * 11/1989 Signori ..... 36/131
5,261,689 A 11/1993 Carpenter et al. ..... 280/618
5,437,112 A * 8/1995 Johnston ..... 36/128
5,752,331 A 5/1998 Perrisoud et al. ..... 36/117.1
5,894,684 A 4/1999 Sand et al. ..... 36/117.1
5,901,971 A 5/1999 Eaton ..... 280/14.2

(Continued)

FOREIGN PATENT DOCUMENTS

DE 28 02 251 A1 7/1979

(Continued)

*Primary Examiner*—Jeff Restifo
(74) *Attorney, Agent, or Firm*—Greenblum & Bernstein, P.L.C.

(57) ABSTRACT

A device for retaining a boot on a board adapted to a sporting activity, and a boot therefor. The device includes a base, a lateral edge, a rear support element, and at least one linkage for holding the boot above the base. The edge and the rear support element each have an inner surface. One or several of the inner surfaces of the device has at least one friction plate that projects at least partially with respect to the inner surface, the friction plate being provided at least to oppose a movement of the boot in relation to the base.

21 Claims, 4 Drawing Sheets

U.S. PATENT DOCUMENTS

| | | | | |
|---|---|---|---|---|
| 5,946,827 | A | 9/1999 | Okajima | 36/58.5 |
| 5,967,531 | A | 10/1999 | Saillet | 280/11.36 |
| 6,017,042 | A | 1/2000 | Paris | 280/14.2 |
| 6,076,848 | A | 6/2000 | Rigal et al. | 280/634 |
| 6,102,429 | A | 8/2000 | Laughlin et al. | 280/617 |
| 6,123,342 | A | 9/2000 | Grell | 280/11.36 |
| 6,206,403 | B1 | 3/2001 | Black et al. | 280/618 |
| 6,231,057 | B1 | 5/2001 | Reuss et al. | 280/14.21 |
| 6,267,403 | B1 | 7/2001 | Bossin et al. | 280/625 |
| 6,347,805 | B1 | 2/2002 | Maravetz et al. | 280/624 |
| 6,394,484 | B1 | 5/2002 | Maravetz et al. | 280/624 |
| 6,520,511 | B2 | 2/2003 | Gonthier | 280/11.36 |
| 6,595,542 | B2 | 7/2003 | Okajima | 280/613 |
| 6,863,285 | B2 * | 3/2005 | Gonthier | 280/14.22 |
| 2001/0010418 | A1 | 8/2001 | Gonthier | 280/11.3 |
| 2002/0153699 | A1 | 10/2002 | Okajima | 280/613 |

FOREIGN PATENT DOCUMENTS

| | | | | |
|---|---|---|---|---|
| EP | 0 797 936 | A1 | 10/1997 | |
| EP | 0 985 357 | A1 | 3/2000 | |
| EP | 1 247 552 | A1 | 10/2002 | |
| FR | 2 822 716 | A1 | 10/2002 | |
| GB | 0 028 793 | | 0/1898 | 280/633 |
| GB | 2259639 | A * | 3/1993 | 36/133 |
| WO | WO-98 / 031 247 | A1 | 7/1998 | |
| WO | WO-00 / 021 618 | A2 | 4/2000 | |

* cited by examiner 1
16
20
17
18
25
14
L
W
10
12
22
15
21
5
2
24
11
7
3
6
8
23
9
13

20
17
18
19
1
16
III
15
14
W
10
5
IV
IV
3
L
4
12
2
13
6
III

DEVICE FOR RETAINING A BOOT ON A GLIDING, ROLLING, OR WALKING BOARD ADAPTED TO A SPORTING ACTIVITY, AND THE BOOT THEREFOR

CROSS-REFERENCE TO RELATED APPLICATIONS

This application is a continuation of U.S. patent application Ser. No. 09/968,949, filed on Oct. 3, 2001, now U.S. Pat. No. 6,863,285, issued on Mar. 8, 2005, the disclosure of which is hereby incorporated by reference thereto in its entirety, and the priority of which is hereby claimed under 35 U.S.C. §120.

This application is based upon French Patent Application No. 00 13032, filed Oct. 6, 2000, the disclosure of which is hereby incorporated by reference thereto in its entirety, and the priority of which is hereby claimed under 35 U.S.C. §119.

BACKGROUND OF THE INVENTION

1. Field of the Invention

The present invention relates to the field of devices for retaining a boot on a gliding, rolling, or walking board adapted to a sporting activity, as well as to a boot adapted to be retained by the device.

2. Description of Background and Relevant Information

Devices of the aforementioned type are used in snowboarding, skiing, skateboarding, roller skating, snowshoeing, and the like.

Certain binding devices are provided to retain flexible boots on the board, while others are provided to retain rigid boots.

In the case of flexible boots, in snowboarding, for example, a device generally includes a base provided for receiving at least partially the sole of the boot, at least one lateral edge connected to the base so as to be opposite lateral portions of the boot, a rear support element provided to receive the boot upper at the rear of the user's lower leg, and at least one linkage for holding the boot above the base, the edge and the rear support element each having an inner surface provided to be opposite the boot.

Such a device retains the boot on the board during steering by the rider/user.

However, it has been found that during steering, the boot makes small displacements within its retention volume on the device. These small displacements hinder the accuracy of the steering of the board.

SUMMARY OF THE INVENTION

An object of the present invention is to reduce the frequency and/or the amplitude of the aforementioned displacements.

To this end, the invention proposes a device for retaining a boot on a gliding, rolling, or walking board adapted to a sporting activity, the device including a base provided to receive at least partially the sole of the boot, at least one lateral edge connected to the base so as to be opposite lateral portions of the boot, a rear support element provided to receive the boot upper at the rear of the user's lower leg, and at least one linkage for holding the boot above the base, the edge and the rear support element each having an inner surface provided to be opposite the boot.

One or several of the inner surfaces of the retaining device of the invention has at least one friction plate that projects at least partially with respect to the inner surface, the friction plate having a friction surface or a friction arrangement provided at least to oppose movement, such as spacing, of the boot from the base.

The boot of the invention has at least one friction plate that projects at least partially with respect to a lateral portion of the sole and/or with respect to a portion of the upper.

As a result of the friction-increasing structure according to the invention, i.e., whereby the friction between the boot and the retaining device is increased compared to the friction between the boot and the retaining device without such structure, the boot sole tends to remain in support on the base. Therefore, the boot upper tends to remain immobile with respect to the device. Consequently, the small displacements of the boot within its retaining volume on the device are reduced. This advantageously makes the steering of the board more accurate.

BRIEF DESCRIPTION OF DRAWINGS

Other characteristics and advantages of the invention will be better understood from the description that follows, with reference to the annexed drawings showing, by way of non-limiting examples, how the invention can be embodied, and in which.

DETAILED DESCRIPTION OF THE INVENTION

The first embodiment is described hereinafter with reference to FIGS. 1–4.

Figure 1:
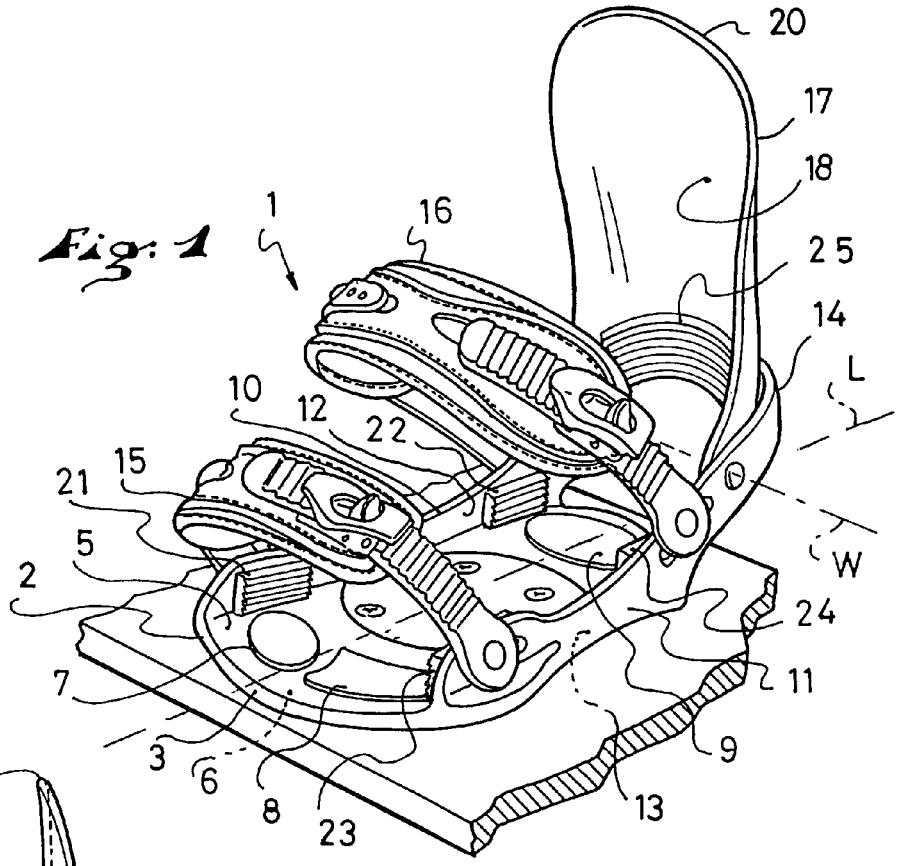
FIG. 1 is a perspective view of a device for retaining a boot on a board, according to a first embodiment of the invention.

A device 1 for retaining a boot on a board, i.e., a strap-in binding, is shown in perspective in FIG. 1.

For reasons of convenience, the boot is not shown, although its position with respect to the retention device is readily apparent to those skilled in the art.

In a known manner, the device 1 includes a base 2 provided to receive at least partially the sole of a boot. The base 2 has a front end 3 and a rear end 4 which demarcate its length, along a longitudinal direction L of the device 1. The base 2 has an upper surface 5 provided to be opposite the sole, as well as a lower surface 6 provided to be opposite the board.

The longitudinal direction L of the device 1 is the same as that of the boot, when the latter is retained on the device 1.

Preferably, the base 2 is provided with front pads 7, 8 and a rear pad 9 which project, respectively, in relation to the upper surface 5. Each pad 7, 8, 9 is affixed to the base by a means such as nesting, gluing, or the like. The pads are provided to receive the boot sole.

The device 1 also has a first lateral edge 10 and a second lateral edge 11. The edges 10, 11 are connected to the base 2 so that their respective inner surfaces 12, 13 are opposite lateral portions of the boot. The edges 10, 11 are oriented substantially along the longitudinal direction L. The edges 10, 11 preferably form a unitary piece with the base 2, but they could also be fixed to the base 2 or journalled with respect to the base along a longitudinal axis.

Preferably, an arch 14 connects the lateral edges 10, 11 to one another toward the rear end 4 of the base 2.

Retaining elements, shown in the form of linkages 15, 16, are provided to removably retain the boot on the device 1. The linkages 15, 16, which can be opened or closed by the user, connect the lateral edges 10, 11, respectively.

A rear support element 17, or high-back, is affixed to the base 2 by a mechanism shown in the form of a journal on the lateral edges 10, 11. The journal is positioned along a transverse axis W of the device 1.

The rear support element 17 has an inner surface 18 having a forwardly facing concave shape to receive the boot upper at the rear of the user's lower leg.

Figure 2:
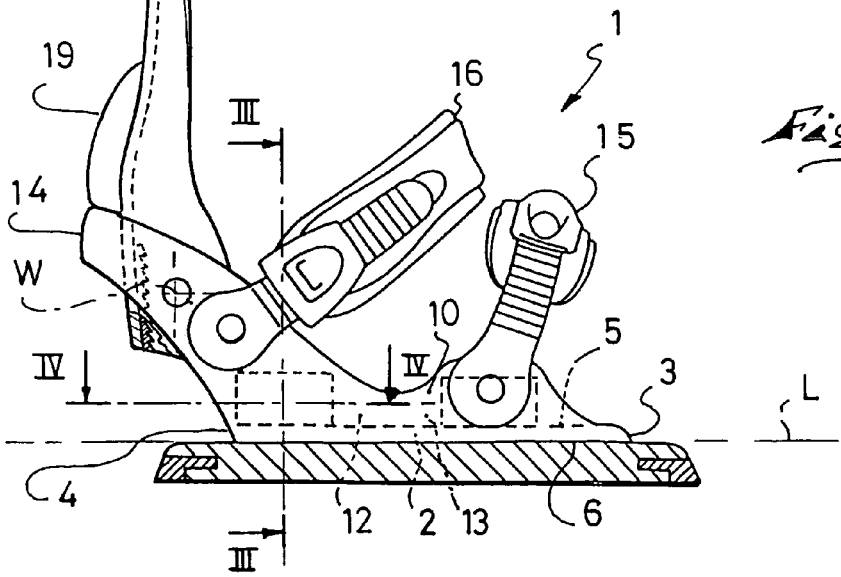
FIG. 2 is a side view of the device of FIG. 1.

FIG. 2 shows additional aspects of the device 1.

An abutment 19, adjustably affixed by any expedient to the rear support element 17, limits a rotation of the latter along the transverse axis W. When the abutment 19 is in support on the arch 14, an upper end 20 of the rear support element 17 can move no farther away from the front end 3 of the base 2.

In this case, the user can take rear support with the lower leg by pressing on the inner surface 18 along the longitudinal direction L.

According to the invention, as seen better in FIG. 1, a first friction plate 21 and a second friction plate 22 project, at least partially, with respect to the inner surface 12 of the first lateral edge 10.

Similarly, a third plate 23 and a fourth plate 24 project with respect to the inner surface 13 of the second lateral edge 11, and a fifth plate 25 projects with respect to the inner surface 18 of the rear support element 17.

Each of the plates 21, 22, 23, 24, 25 includes a friction surface or friction arrangement provided to oppose a separation, or spacing, of the boot sole with respect to the upper surface 5 of the base 2.

For reasons of convenience, only the second plate 22 is described in detail hereinafter with reference to FIGS. 3 and 4.

Figure 3:
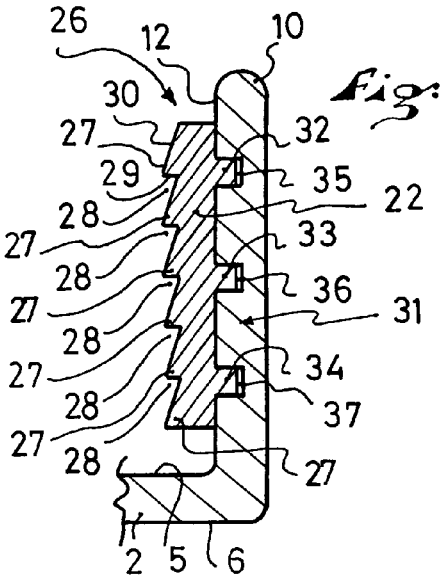
FIG. 3 is a cross-section along the line III—III of FIG. 2.

As seen clearly in FIG. 3, the friction arrangement is embodied as alternating projections and recesses arranged on a friction surface 26 of the second plate 22.

Preferably, each projection is formed by a tooth 27 which extends over the surface 26, substantially parallel to the upper surface 5 of the base 2.

The surface 26 thus includes a series of several teeth 27 separated by grooves 28.

The teeth 27 are provided to cooperate with a lateral portion of the boot as follows, when this portion is in support on the friction surface 26 of the plate 22.

The shape of the teeth enables a sliding of the boot toward the base 2, but opposes a spacing of the boot from the base, in the manner of fish scales against water.

To this end, each tooth has a particular geometry. A tooth 27 has a first surface 29 substantially parallel to the base 2, as well as a second surface 30 which forms, together with the first surface, an angle comprised between 10 and 80 degrees.

For a given tooth, the second surface 30 is farther from the base 2 than the first surface 29.

The top of each tooth, defined by the edge coming from the intersection of the first surface 29 with the second surface 30, tends to penetrate into the edge of the sole, or into the upper of the boot. As a result the boot sole tends to remain in contact with the base 2.

Preferably, the friction plate 22 is a piece affixed to the inner surface 12. An affixation surface 31 of the friction plate 22 takes support on the inner surface 12 of the first edge 10. Ribs 32, 33, 34 of the friction plate 22, projecting with respect to the affixation surface 31, are housed in cavities 35, 36, 37 of the first lateral edge 10. Preferably, the shapes of the ribs and of the cavities are complementary.

The affixing of the friction plate 22 to the lateral edge 10 is obtained, for example, by a gluing of the affixation surface 31 on the inner surface 12, by a tight assembly of the ribs 32, 33, 34 of the friction plate 22 in the cavities 35, 36, 37 of the edge 10, or by a combination of these means.

The other friction plates 21, 23, 24, 25 have structures similar to the second plate 22, and are affixed to the device 1 in the same manner.

As shown in FIG. 1, the first 21 and third 23 plates are located in the area of the front linkage 15. The second 22 and fourth 24 plates are located in the area of the rear linkage 16. The fifth plate 25 is located toward the rear of the device 1, beneath the rear support element 17. Thus, the linkages 15, 16 push portions of the boot directly on the plates.

When the user steers the board, the movements of the boot with respect to the device are braked. As a result, the steering of the board is more accurate.

Other embodiments of the invention are briefly presented by means of FIGS. 5–9. Only the differences with respect to the first embodiment are shown.

Figure 5:
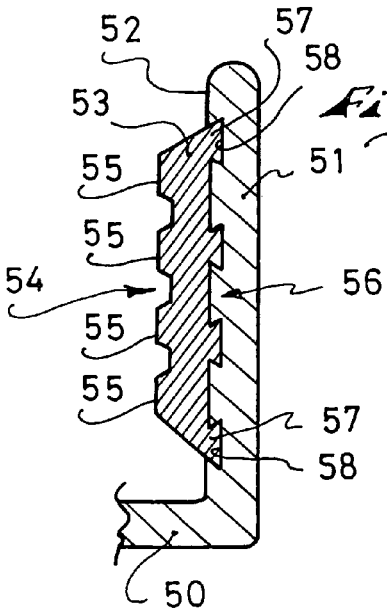
FIG. 5 is similar to FIG. 3, according to a second embodiment.

For the second embodiment, as seen in FIG. 5, a base 50 is extended upward by an edge 51. An inner surface 52 of the edge 51 receives a friction plate 53. The latter has a friction surface 54 having a trapezoidal toothing, whose teeth 55 are substantially parallel to the base 50. An affixation surface 56 of the plate 53 and the edge 51 have dovetail tenons 57 and cutouts 58, respectively, for assembly with one another.

Figure 6:
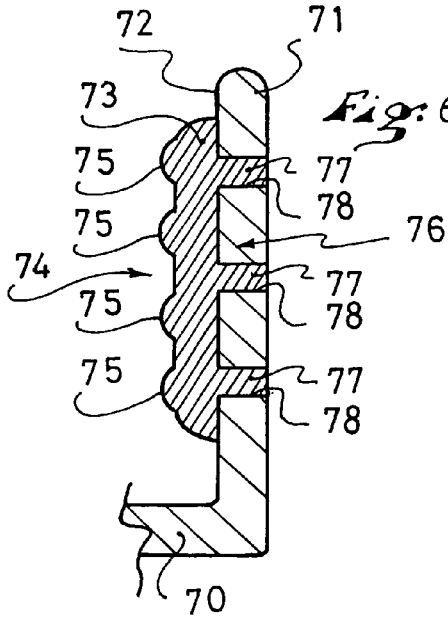
FIG. 6 is similar to FIG. 3, according to a third embodiment.

For the third embodiment, as seen in FIG. 6, a base 70 is extended upward by an edge 71. An inner surface 72 of the edge 71 receives a friction plate 73. The latter has a corrugated friction surface 74, whose projecting portions 75 are substantially parallel to the base 70. An affixation surface 76 of the plate 73 and the edge 71 have ribs 77 and grooves 78, respectively, for assembly with one another.

Figure 7:
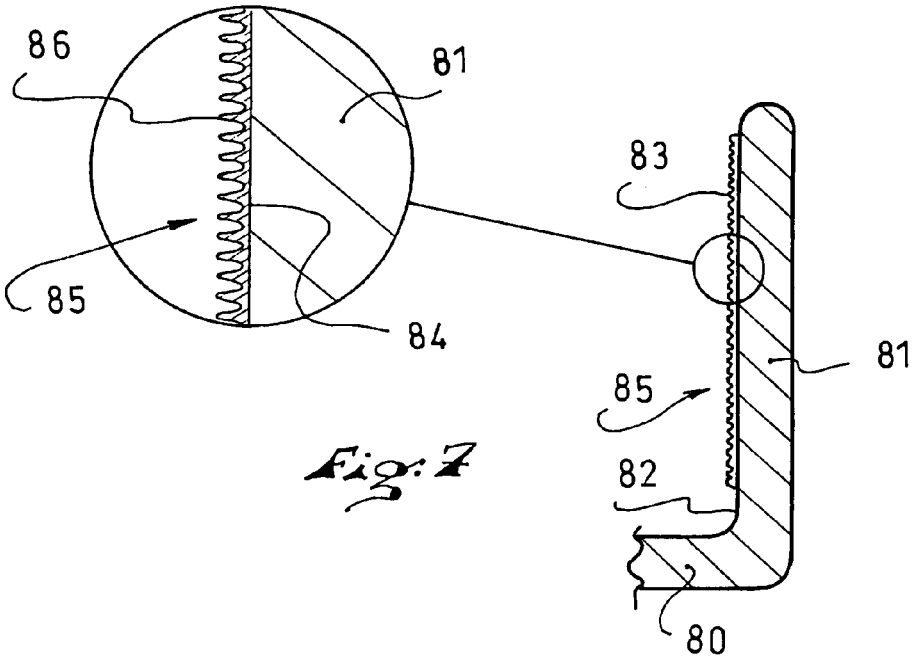
FIG. 7 is similar to FIG. 3, according to a fourth embodiment.

For the fourth embodiment, as seen in FIG. 7, a base 80 is extended upward by an edge 81. An inner surface 82 of the edge 81 receives a friction plate 83. The latter is obtained in the form of a fabric layer. The plate 83, or fabric layer, has a permanent affixation surface 84 opposite a friction surface 85. The permanent affixation surface 84 is affixed to the edge 81, for example, by gluing or by stitching.

The friction surface 85 has a multitude of projecting fingers 86. Each finger, for example, has a length comprised between 0.1 and 3.0 millimeters, and preferably between 0.8 and 2.1 millimeters. The diameter of a finger is comprised, for example, between 0.05 and 1.0 millimeters, and preferably between 0.05 and 0.2 millimeters.

The fingers 86 are juxtaposed so as to form a carpet-like surface. They have the particularity of gripping another similar or identical layer which could be arranged on the boot to be received. The contact of the fabric layer or plate 83 with a similar layer, connected to the boot, strongly brakes the movements of the boot with respect to the device.

A finger 86 can have the shape of a needle or any other shape, such as that of a mushroom, a loop, or the like.

The plate 83 is preferably made of plastic materials.

According to the various embodiments, the invention encompasses a sports board, such as a gliding, rolling, or walking board, used, for example, in snowboarding, skiing, skateboarding, roller skating, snowshoeing, and the like, which includes a device that includes a friction-increasing structure for engagement with the user's boot. The friction-increasing structure can be arranged to project from any of a plurality of parts of a boot-retaining device, as shown in FIG. 1, as an example. In the various examples described, the friction-increasing structure can take the form of a plurality of projections adapted to contact the boot, such projections taking the form, for example, of a plurality of teeth, or a plurality of ribs, or a plurality of fingers, or other non-smooth boot-contacting face.

Figure 4:
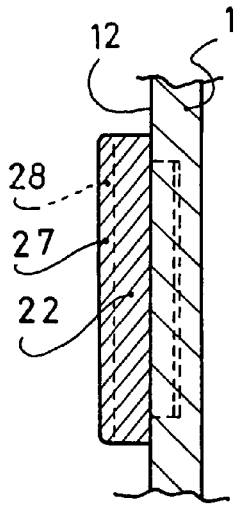
FIG. 4 is a cross-section along the line IV—IV of FIG. 2.

In the examples illustrated in FIGS. 1–7, for example, at least in vertical cross section, the boot-contacting face of the friction-increasing structure, which includes any of surfaces 26, 54, 74, and 85, for example, is nonlinear. Such nonlinearity provides a contacting, or engagement, face for braking the boot with regard to forces that would tend to move the boot away from an upwardly facing support surface of the boot. In a particular example, as shown in FIG. 4, however, in horizontal cross section, the boot-contacting face of the friction-increasing structure can be straight.

Figure 8:
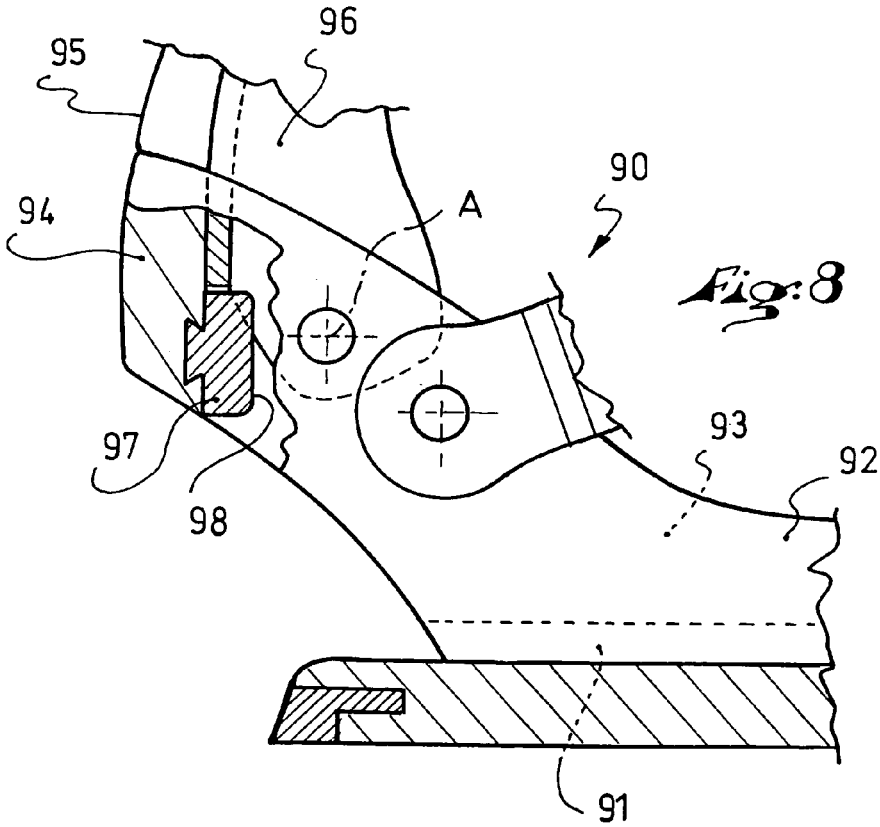
FIG. 8 is a partial side view similar to FIG. 2, according to a fifth embodiment.

The fifth embodiment, presented by means of FIG. 8, only partially shows a retaining device 90.

The device 90 includes a base 91 overlaid by a first lateral edge 92 and a second lateral edge 93, these edges being connected by an arch 94 toward the rear of the device.

An abutment 95 is affixed to a rear support element 96 to limit a rearward tilting of the latter along the transverse axis A. To this end, the abutment 95 takes support on the arch 94. A friction plate 97 is arranged on the arch 94, such that a friction surface 98 of the plate can rub or press on the boot.

Preferably, the plate 97 projects with respect to the rear support element 96. The plate 97 is affixed to the arch 94 by any means, such as embedding, gluing, screwing, or the like.

In any event, the retaining device can be made out of all of the materials and according to all of the techniques known to a person with ordinary skill in the art.

In particular, the base 2, 91, the lateral edges 10, 11, 92, 93, and the arch 14, 94, preferably form a unitary piece made, for example, of a rigid plastic material. The friction plates are preferably made of a flexible plastic material containing polyurethane, silicon, or rubber. It can also be made of a more rigid plastic material.

Figure 9:
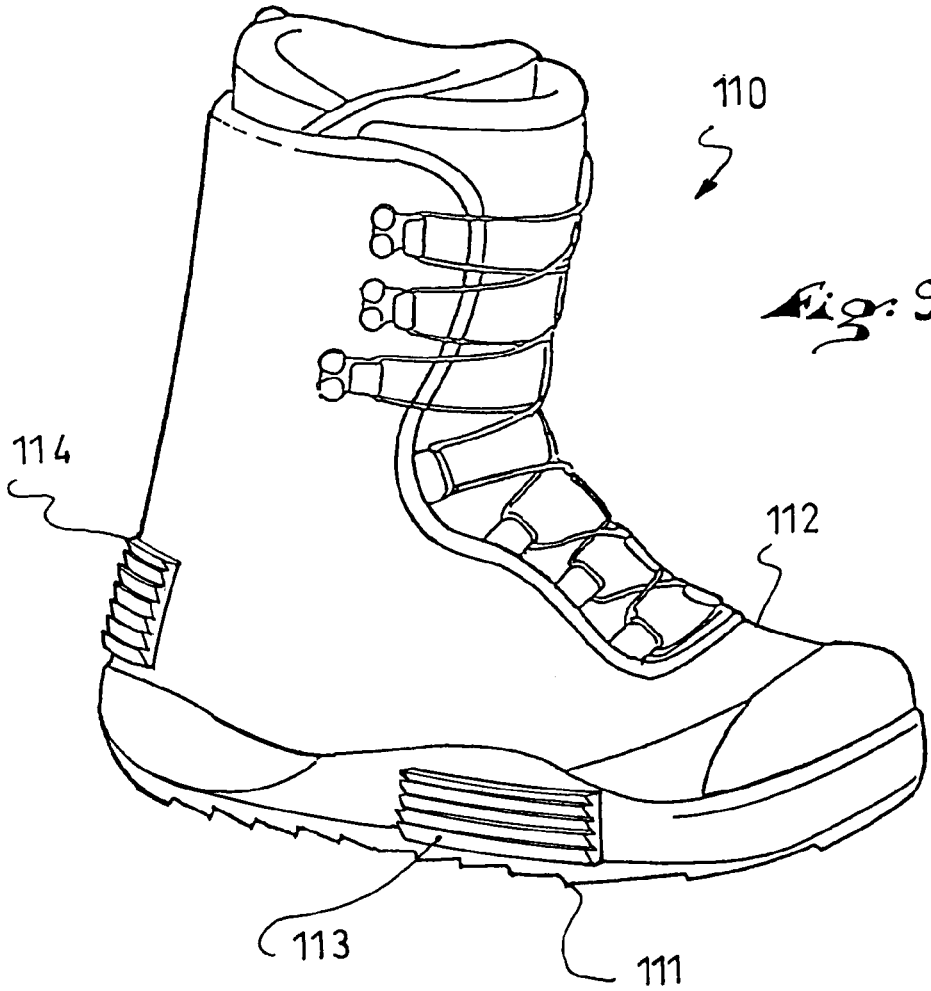
FIG. 9 is a perspective view of a boot adapted to be retained by a device.

A boot 110 adapted to be retained on the device according to the invention is shown in FIG. 9.

The boot 110 has a sole 111 and an upper 112. Any structure is suited to make the boot 110, the sole 111 and the upper 112 being preferably flexible or semi-rigid.

The boot 110 is provided with friction plates identical or similar to those used for the retaining device.

The boot 110 has at least one friction plate that projects at least partially with respect to a lateral portion of the sole and/or with respect to a portion of the upper.

For example, a plate 113 is arranged on one side of the boot, and a plate 114 is arranged at the rear, above the heel or at the level of the heel.

In the embodiment of the boot of the invention shown in FIG. 9, the upper is a high upper, that is, it includes a portion that extends along the lower leg of the wearer above the ankle, as well as a tongue that extends longitudinally beneath a lacing zone within an opening between the transversely spaced apart lateral and medial portions of the upper, rearwardly from a location above the top of the foot and upwardly along the front of the lower leg. The rear friction plate 114 is shown as extending rearward of the front of the lower leg portion of the upper. Further, both of the friction plates 113 and 114 are shown in FIG. 9 to have forward ends that are spaced rearward from a front end of the boot and which extend rearwardly of the front of the lacing zone. In addition, like the teeth and projecting portions of the bindings of the previous drawing figures, which can be substantially parallel to the upper surface of the base of the binding, the projecting portions of the friction plates 113 and 114 are shown in FIG. 9 to be substantially parallel to the walking surface of the sole 111, i.e., substantially horizontal when the sole of the boot is supported on a horizontally positioned upper surface of the base of the binding.

The boot 110 can include one or several friction plates. These plates can be located on any portion of the boot adapted to come into contact with the retaining device. More particularly, as shown in FIG. 9, the friction plate(s) are positioned on one or more exposed portions of the boot such that they can contact part(s) of the retaining device, such as a lateral edge, the arch, or the rear support element. On the other hand, in FIG. 9, the uppermost edge of the friction plate 113 is shown to be spaced transversely from a longitudinal vertical median plane of the boot.

The invention is not limited to the particular examples described hereinabove, and includes all of the technical equivalents that fall within the scope of the claims that follow.

In particular, one can provide a different number of friction plates, or that a plate be made of a plurality of distinct portions.

One can provide that a plate and the edge or the associated piece form a unitary piece. In this case, the plate is integrated into the structure of the device or of the boot.

The affixation surface of a plate can have protuberances of any shape.

The projections and recesses of the friction surface of a plate can have any suitable shape.

A friction plate can extend over the entire length of an edge of the base or on one side of the boot.

Yet, for the device, the arch can be at the front of the rear support element, and a friction plate can be arranged on the arch to cooperate with the boot.

In any event, to obtain the results according to the invention, the friction plates can be arranged on the device only, on the boot only, or on both the device and the boot.

What is claimed is:

1. An assembly for attachment to a gliding, rolling, or walking board adapted to be used in a sporting activity, the assembly comprising:

a boot comprising:

a sole;

an upper;

at least one friction plate comprising a first side completely positioned against the boot, said friction plate further comprising a second side, at least a part of said second side having projections projecting outwardly with respect to an outer lateral portion of the sole and/or with respect to an outer portion of the upper; and a device for retaining said boot on said gliding, rolling, or walking board, said device comprising:

a base comprising an upper surface to support and to be opposite a lowermost walking surface of the sole of said boot;

at least one lateral edge connected to the base so as to be opposite at least the lateral portion of said boot;

a rear support element provided to receive the upper of said boot at a rear of a user's leg, said lateral edge and said rear support element each having an inner surface provided to contact said boot;

at least one linkage adapted to extend over said boot to hold said boot on said base;

at least one friction-increasing structure projecting outwardly from at least one of the inner surfaces to oppose upward movement of said boot in relation to the upper surface of said base and for reducing small displacements of the upper of said boot with respect to said device during use of the board.

2. A flexible boot adapted to a sporting activity, the boot being adapted to be engaged with inner surfaces of a boot retaining device, said boot comprising:

a sole;

an upper having a high upper portion adapted to extend at least partially around a lower leg of a wearer;

at least one friction plate comprising a first side completely positioned against the boot, said friction plate further comprising a second side, at least a part of said second side having projections projecting outwardly with respect to an outer lateral portion of the sole and/or with respect to an outer portion of the upper;

said friction plate having a front end spaced rearwardly from a front end of the boot;

said friction plate being structured and arranged on the boot to provide for contact between said projections and a portion of the boot retaining device to brake the boot relative to the boot retaining device upon exertion of an upward force by the boot.

3. A flexible boot according to claim 2, wherein:

said at least one friction plate is/are distinct from a remainder of the boot.

4. A flexible boot according to claim 2, wherein:

said friction plate is positioned on the boot for contact with at least one of the following structural elements of the boot retaining device: one of a pair of upwardly extending lateral edges, an arch connecting the pair of upwardly extending lateral edges, and a rear support element extending upwardly relative to the lateral edges.

5. A flexible boot according to claim 2, wherein:

said friction plate is constituted of an alternation of projections and recesses for engagement with recesses and projections, respectively, of the boot retaining device.

6. A flexible boot according to claim 5, wherein:

said projections are teeth; and said recesses are grooves.

7. A flexible boot according to claim 2, wherein:

said friction plate extends along a rear of the boot.

8. A flexible boot according to claim 2, wherein:

said at least one friction plate comprises at least two friction plates, a first of said two friction plates being arranged at a rear of the boot and a second of said two friction plates being arranged at a side of the boot.

9. A flexible boot adapted to a sporting activity, the boot being adapted to be engaged with inner surfaces of a boot retaining device, said boot comprising:

a sole;

an upper;

at least one friction plate comprising a first side completely positioned against the boot, said friction plate further comprising a second side, at least a part of said second side having projections projecting outwardly with respect to an outer lateral portion of the sole and/or with respect to an outer portion of the upper;

said friction plate being constituted of an alternation of teeth and grooves;

said teeth and said grooves extending substantially parallel to a walking surface of said sole and, when the sole of the boot is supported on a horizontal support surface of the boot retaining device, said teeth and said grooves extending substantially horizontally.

10. A flexible boot adapted to a sporting activity, the boot being adapted to be engaged with inner surfaces of a boot retaining device, said boot comprising:

a sole;

an upper;

at least one friction plate comprising a first side completely positioned against the boot, said friction plate further comprising a second side, at least a part of said second side having projections projecting outwardly with respect to an outer lateral portion of the sole and/or with respect to an outer portion of the upper;

said friction plate extending along a side of the boot, said friction plate having an uppermost edge, an entirety of said uppermost edge being spaced transversely from a longitudinal vertical median plane of the boot.

11. A flexible boot adapted to a sporting activity, the boot being adapted to be engaged with inner surfaces of a boot retaining device, said boot comprising:

a sole;

an upper;

at least one friction plate fixed with respect to and projecting at least partially with respect to an outer lateral portion of the sole and/or with respect to an outer portion of the upper for contacting one or more of the inner surfaces of the boot retaining device, said friction plate having a top and a bottom, said top and bottom of said friction plate being positioned against the boot;

said friction plate having an uppermost edge, an entirety of said uppermost edge being spaced transversely from a longitudinal vertical median plane of the boot.

12. A flexible boot according to claim 11, wherein:

said friction plate has a forward end spaced rearwardly from a front end of the boot.

13. A flexible boot according to claim 11, wherein:

said upper includes a lacing zone having a forward end spaced from a front end of the boot; and a lace extending within said lacing zone between lateral and medial portions of the upper;

said friction plate extends rearwardly beyond said forward end of said lacing zone.

14. A flexible boot adapted to be supported and retained on a gliding, rolling, or walking board by means of a binding device, said binding device including a pair of transversely spaced-apart upwardly extending lateral edges and a rear support element extending upward at a rear of the binding, said boot including outward-facing surfaces for engaging inward-facing surfaces of the binding device for retaining said boot on said board during use of the board, said boot further comprising:

a sole;

an upper;

at least one friction plate comprising a first side completely positioned against a part of the boot, said friction plate further comprising a second side, at least a part of said second side having projections projecting outwardly with respect to an outer lateral portion of the sole and/or with respect to an outer portion of the upper, said projections comprising at least some of said outward-facing surfaces of said boot and positioned on said boot to engage an inward-facing surface of at least one of said lateral edges and/or to engage an inward-facing surface of said rear support element, said projections extending substantially horizontally when the sole of the boot is supported on a horizontal support surface of the binding device for engagement with the inward-facing surfaces of the binding device to brake upward movement of the boot relative to the binding device;

said friction plate extending along a rear of the boot.

15. A flexible boot according to claim 14, wherein:

said friction plate is made unitary with a part of the boot to which said friction plate is positioned against.

16. A flexible boot adapted to be supported and retained on a gliding, rolling, or walking board by means of a binding device, said binding device including a pair of transversely spaced-apart upwardly extending lateral edges and a rear support element extending upward at a rear of the binding, said boot including outward-facing surfaces for engaging inward-facing surfaces of the binding device for retaining said boot on said board during use of the board, said boot further comprising:

a sole;

an upper;

at least one friction plate comprising a first side completely positioned against a part of the boot, said friction plate further comprising a second side, at least a part of said second side having projections projecting outwardly with respect to an outer lateral portion of the sole and/or with respect to an outer portion of the upper, said projections comprising at least some of said outward-facing surfaces of said boot and positioned on said boot to engage an inward-facing surface of at least one of said lateral edges and/or to engage an inward-facing surface of said rear support element, said projections extending substantially horizontally when the sole of the boot is supported on a horizontal support surface of the binding device for engagement with the inward-facing surfaces of the binding device to brake upward movement of the boot relative to the binding device;

said friction plate extending along a side of the boot.

17. A flexible boot according to claim 16, wherein:

said friction plate is made unitary with a part of the boot to which said friction plate is positioned against.

18. A flexible boot according to claim 16, wherein:

said friction plate has an uppermost edge, an entirety of said uppermost edge being spaced transversely from a longitudinal vertical median plane of the boot.

19. A flexible snowboard boot adapted to be supported and retained on a snowboard by means of a strap-in snowboard binding, the binding including a base, first and second transversely spaced apart lateral edges extending upwardly from the base, first and second longitudinally spaced apart straps adapted to extend over the boot and adapted to connect to said first and second lateral edges, a rear arch connected to said first and second lateral edges and adapted to extend around a rear of the boot, and a high-back mounted pivotally relative to said first and second lateral edges, said boot comprising:

a sole having a walking surface and adapted to be supported on the base of the binding;

an upper including a lower portion and an upper portion, said lower portion being adapted to extend over a foot of a wearer of the snowboard boot and said upper portion being adapted to extend along a lower leg of the wearer, a rear of the upper portion of the upper being adapted to engage with the high-back of the binding;

said upper having a lateral portion and a medial portion, said lateral and medial portions being transversely spaced apart;

said upper further including a tongue extending beneath and between said lateral and medial portions of said upper;

a lacing zone extending from a front end within said lower portion to an upper end within said upper portion;

a lace extending within said lacing zone between the lateral and medial portions of the upper;

at least one friction-increasing device comprising a first side positioned along the boot from a top to a bottom of said device, said friction-increasing device further comprising a second side, at least a part of said second side having projections projecting outwardly with respect to an outer lateral portion of the sole and/or with respect to an outer portion of the upper;

said projections of said friction-increasing device extending rearwardly beyond said front end of said lacing zone;

said projections being positioned on the boot to be adapted to engage, during use of the boot while mounted upon the snowboard and retained by the binding, one or more surfaces of the following for opposing upward movement of the boot relative to the base of the binding: the first lateral edge of the binding, the second lateral edge of the binding, and the high-back of the binding.

20. A flexible snowboard boot according to claim 19, wherein:

said friction-increasing device is made unitary with a part of the boot to which said friction-increasing device extends along.

21. A flexible snowboard boot according to claim 19, wherein:

said projections extend substantially horizontally when the sole of the boot is supported on a horizontal support surface of the binding for engagement with said one or more surfaces of the binding to brake upward movement of the boot relative to the binding device.

* * * * *